United States Patent [19]

Arozena

[11] Patent Number: 4,932,083

[45] Date of Patent: Jun. 12, 1990

[54] INSERT URINAL COMPARTMENT FOR TOILET BOWLS

[76] Inventor: Andrew A. Arozena, 1421 17th St., Los Osos, Calif. 93402

[21] Appl. No.: 364,877

[22] Filed: Jun. 12, 1989

[51] Int. Cl.[5] ..... E03D 13/00; A47K 11/00

[52] U.S. Cl. ..... 4/301; 4/300; 4/144.1; 4/420.3; 4/445

[58] Field of Search ..... 4/301, 326, 144.1–144.2, 4/114.1, 311, 661, 300, 445, 420.3

[56] References Cited

U.S. PATENT DOCUMENTS

| | | | |
|---|---|---|---|
| 681,541 | 8/1901 | Gosieniecki | 4/341 |
| 1,056,361 | 3/1913 | Podmore | 74/14 |
| 3,336,602 | 8/1967 | Kubit | 4/301 |
| 3,412,408 | 11/1968 | Michal, Jr. | 4/341 |
| 3,500,480 | 3/1970 | Michal, Jr. | 4/301 |
| 3,654,638 | 4/1972 | Nye | 4/144.1 |
| 4,197,598 | 4/1980 | Lemmon | 4/326 |
| 4,282,611 | 8/1981 | O'Day | 4/144.1 |
| 4,437,430 | 3/1984 | DeBardeleben | 119/1 |
| 4,450,595 | 5/9184 | Saccomanno | 4/301 |

FOREIGN PATENT DOCUMENTS

| | | | |
|---|---|---|---|
| 1273444 | 7/1968 | Fed. Rep. of Germany | 4/420.3 |

*Primary Examiner*—Henry K. Artis

*Attorney, Agent, or Firm*—Harry W. Brelsford

[57] ABSTRACT

An open top basin for receiving urine is inserted into the front portion of a conventional single cavity toilet bowl. The basin has a normally closed valve in the bottom of the basin to release the accumulated urine. A float rests on the surface of the water in the toilet bowl and is connected to the valve. When the toilet bowl is flushed, the water level drops, the float drops and opens the valve to release the accumulated urine into the toilet to be flushed away.

4 Claims, 2 Drawing Sheets

INSERT URINAL COMPARTMENT FOR TOILET BOWLS

This invention relates to toilet bowls having separate compartments for feces and urine and has particular reference for an insert compartment for urine having automatic flushing of the urine section when the feces section is flushed.

This invention relates generally to a water saving structure and therefore to environmental conservation because it reduces the waste of water, a natural resource now in short supply.

BACKGROUND OF THE INVENTION

Various structures have been proposed to reduce the amount of water used by toilet bowls to flush urine. Generally special purpose toilet bowls have been proposed that have separate compartments for urine and feces. Some of these use separate flushing systems for urine and for feces in an attempt to reduce water usage in this fashion. Others have inserted separate compartments into a standard toilet bowl but these either drain continuously or have complicated structures to drain out the urine.

SUMMARY OF THE INVENTION

I have devised an insert compartment for a standard toilet bowl to receive urine. The urine is held for a period of time until the main bowl is flushed, whereupon a drain in the compartment open to discharge the urine into the main bowl where it is flushed in the usual manner.

The toilet bowl may be used in the usual fashion to receive feces, and flushing the feces automatically empties the urine compartment and flushes the urine away also.

If the frequency of feces flushing is low, a signal float may be provided to indicate when the urine compartment is full and needs flushing independently of flushing feces. This independent flushing of the main bowl opens the compartment valve to flush the urine.

If desired, an attachment may be secured to the bowl in the form of a raised receptacle that drains into the urine insert compartment. This may be at a height above the bowl seat, for use my male persons.

BRIEF DESCRIPTION OF THE DRAWINGS

Referring to the drawings integral part of this specification.

DETAILED DESCRIPTION

Figure 1:
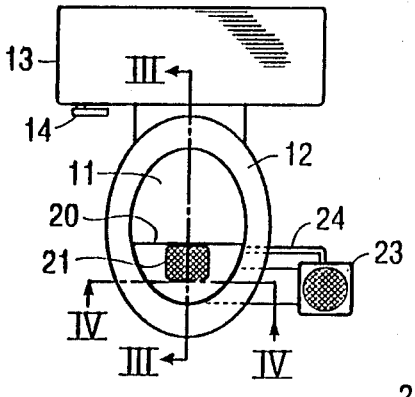
FIG. 1 is a plan view of a toilet bowl and insert urine compartment.
Figure 3:
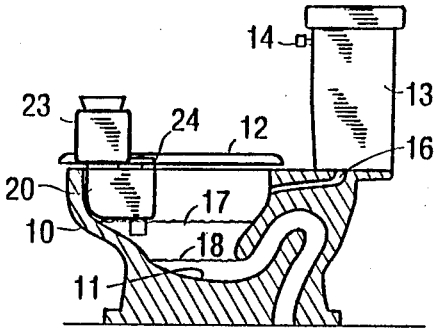
FIG. 3 is a sectional view taken along the line III—III of FIG. 1.
Figure 2:
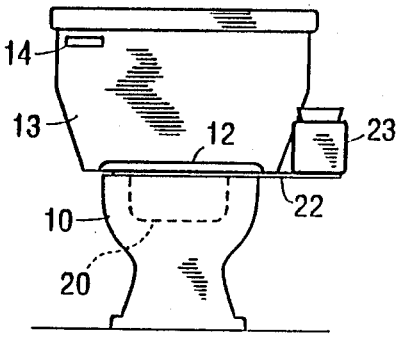
FIG. 2 is a front elevation view of the toilet of FIG. 1 showing the insert compartment in broken outline.

Referring to FIGS. 1, 2 and 3 a conventional toilet bowl 10 has a single internal cavity 11. An oval seat 12 is disposed over the rim of the bowl 10 for the comfort of the user. Connected to the bowl 10 is a conventional water tank 13 which releases water when a manual handle 14 is rotated. Water leaves the tank 14 through a conduit 16 to flush the interior cavity 11. The cavity 11 normally has a water level shown by the broken line 17 and this level is determined by the outlet trap. When the toilet is flushed, the water level momentarily drops to the line 18.

Provided particularly in accordance with the invention is a basin 20 disposed in the forward portion of the bowl cavity 11 and having a generally open top at the same level as the top of the toilet bowl 10. If esthetics are important the basin may be partly covered with a screened opening 21 in the center.

Attached to the basin by a mechanical arm 22 is a urine receptacle 23 for use by males and a tube 24 drains this receptacle into the basin 20.

Figure 4:
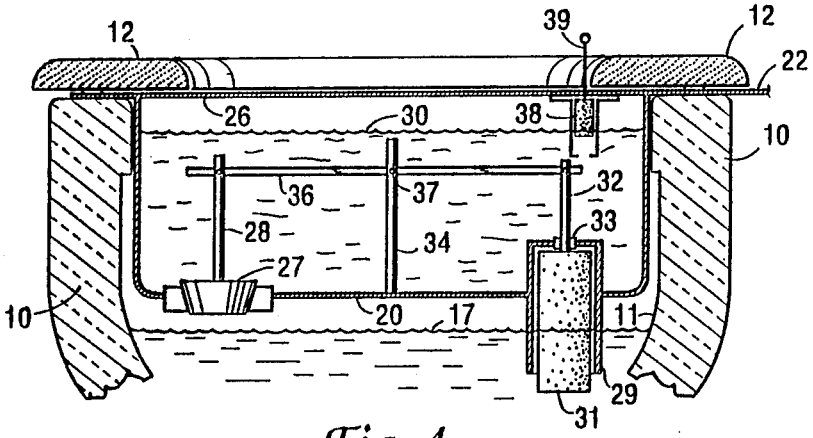
FIG. 4 is a sectional front view on an enlarged scale of the toilet bowl a compartment of FIG. 1 taken along the line IV—IV of FIG. 1.
Figure 5:
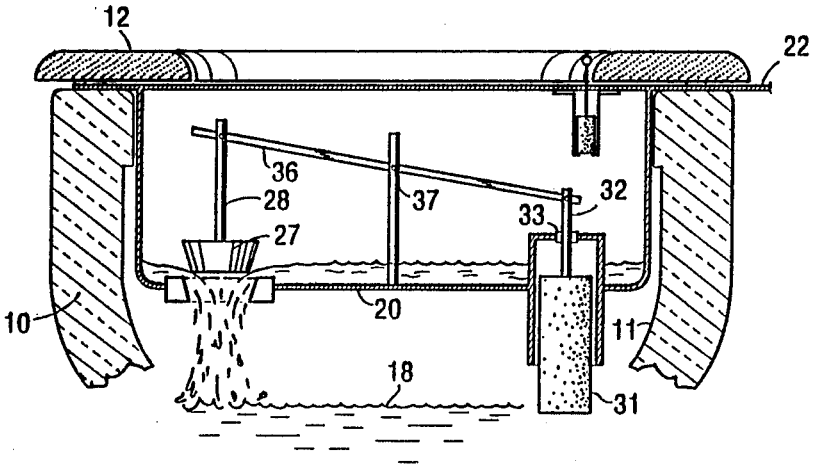
FIG. 5 is a view similar to FIG. 4 but showing the action of the float to open the valve in the bottom of the compartment.

Referring now to FIGS. 4 and 5, the basin 20 is supported on the top of the bowl 10 by sheet material 26 and the sheet material on the right is extended to form the support arm 22 for the urinal attachment 23. Formed in the bottom of basin 20 is a valve 27 of any desired type and I presently prefer a poppet valve. Secured to the top of the valve 27 is a vertical stem 28. Also secured in the bottom of the basin 20 is a cylindrical float guide 29 within which is disposed a float 31 having a vertical stem 32 projecting thru a seal 33 formed in the top of the float guide 27. Mounted in the bottom of the basin 20 is a pivot post 34 to which is pivoted a rocker arm 36 pivoted at 37. The outer ends of the rocker arm 36 are pivoted to the float stem 32 and the valve stem 28.

Referring to FIG. 4, there is shown the normal water level 17 of water inside the cavity 11 of the toilet bowl 10. The float 31 floats in this water and is urged upwardly. The float stem 32 attempts to rotate the rocker arm 36 counter clockwise and the rocker arm 36 acts on the valve stem 28 to keep the valve 27 seated. If now urine 30 is deposited in the basin 20, it will build up in level until a signal float 38 floating on the urine projects a stem 39. This stem will be visible when it projects above the top of the basin 20, whereupon the observer operates the handle 14 of FIG. 3 to flush the cavity 11 of the bowl 10.

Referring to FIG. 5, there is illustrated the momentary condition when the toilet bowl has been flushed. Water in the bowl 10 has now dropped to the level 18 and float 31 has dropped with it, rotating the rocker arm 36 clockwise. This rotation pulls up the valve 27 from its seat and the urine in basin 20 flows downwardly into the bowl cavity 11 to be flushed away.

In normal operation, feces will be received by the rear portion of the bowl 10 and will be flushed away. This feces flushing generally will be at a rate with respect to urine accumulation before the urine builds up to the level shown in FIG. 4.

My invention can be used in conventional toilet bowls without any modification of the conventional bowl. It is a self contained insert placed in the forward section of a conventional toilet bowl. It can be readily removed for cleaning of my insert and cleaning of the toilet bowl 10 by merely lifting it out of the toilet bowl.

I have described my invention with respect to my presently preferred embodiment as required by the patent statutes. It will be apparent to those skilled the art that various modifications can be made. For example, the float 31 could be outboard of the basin 20 and could be of the float type commonly used in water tanks to stop the flow of water. Various types of valves 27 could be used, such as slide valves, reverse poppet valves, rotating valves etc. All such variations and modifications that fall within the time spirit and scope of the invention are included within the scope of the following claims.

I claim:

1. The combination with a conventional single cavity toilet bowl having front and rear portions and a top, and having a normal water level which drops when the bowl is flushed, of an insert urine compartment disposed in the bowl, said insert compartment, comprising:

(a) an insert water tight open top basin having a bottom and disposed in the forward portion of the bowl;

(b) a float normally floating on the normal water level within the bowl and connected to the basin for vertical movement with respect to the basin;

(c) a normally closed valve disposed in the bottom of the basin;

(d) and a mechanical connection between the float and the valve to open the valve when the water level in the bowl drops, whereby flushing the bowl causes the float to drop, thereby opening the valve to release the contents of the basin to the toilet bowl cavity, to be flushed away.

2. The combination of claim 1 wherein the basin is supported on the top of the toilet bowl.

3. The combination of claim 1 wherein a receptacle for urine is disposed outside the toilet bowl above the level of the top of the bowl, and a conduit connects the receptacle and the basin to deliver urine to the basin.

4. The combination of claim wherein the mechanical connection between the float and the valve includes a pivot on the basin and a rocker arm pivoted to the pivot, and the valve and float are connected to the rocker arm.

* * * * *